US010714814B2

(12) United States Patent
Muehlbauer et al.

(10) Patent No.: US 10,714,814 B2
(45) Date of Patent: Jul. 14, 2020

(54) ANTENNA

(71) Applicant: KATHREIN SE, Rosenheim (DE)

(72) Inventors: Helmut Muehlbauer, Berlin (DE); Stefan Reichelt, Chieming (DE); Volker Kuesel, Rosenheim (DE)

(73) Assignee: KATHREIN SE, Rosenheim (DE)

( * ) Notice: Subject to any disclaimer, the term of this patent is extended or adjusted under 35 U.S.C. 154(b) by 287 days.

(21) Appl. No.: 15/432,821

(22) Filed: Feb. 14, 2017

(65) Prior Publication Data

US 2017/0244157 A1 Aug. 24, 2017

(30) Foreign Application Priority Data

Feb. 18, 2016 (DE) ..... 10 2016 001 912

(51) Int. Cl.

| | |
|---|---|
| ***H01Q 1/00*** | (2006.01) |
| ***H01Q 1/24*** | (2006.01) |
| ***H01Q 3/32*** | (2006.01) |
| ***H01Q 21/22*** | (2006.01) |

(52) U.S. Cl.
CPC ..... *H01Q 1/246* (2013.01); *H01Q 3/32* (2013.01); *H01Q 21/22* (2013.01)

(58) Field of Classification Search
CPC ..... H01Q 1/246; H01Q 3/32; H01Q 21/22
See application file for complete search history.

(56) References Cited

U.S. PATENT DOCUMENTS

| | | | | |
|---|---|---|---|---|
| 7,508,343 | B1 * | 3/2009 | Maloratsky | H01Q 3/242 342/374 |
| 8,981,894 | B2 | 3/2015 | Mann et al. | |
| 10,367,261 | B2 * | 7/2019 | Webb | H01Q 3/005 |
| 2006/0002319 | A1 * | 1/2006 | Lee | H04B 7/0608 370/310.1 |
| 2006/0229048 | A1 * | 10/2006 | Carroll | H01Q 1/246 455/268 |
| 2010/0113097 | A1 * | 5/2010 | Seeor | H04W 88/085 455/562.1 |
| 2011/0237315 | A1 * | 9/2011 | Seeor | H01Q 1/246 455/575.7 |

(Continued)

FOREIGN PATENT DOCUMENTS

| | | | |
|---|---|---|---|
| DE | 102009022158 | A1 | 11/2010 |
| DE | 102011009600 | B3 | 3/2012 |

(Continued)

OTHER PUBLICATIONS

"Remote Electrical Tilt System: Overview of related products, installation and control possibilities," Kathrein Product Catalog, Edition Available Jan. 2014, 24 pages.

*Primary Examiner* — Khai M Nguyen
(74) *Attorney, Agent, or Firm* — McCoy Russell LLP

(57) ABSTRACT

The present disclosure relates to an antenna, in particular a mobile communication antenna, especially for a mobile communication base station, the antenna comprising an antenna control unit, a plurality of radiators and a plurality of functional elements, wherein the antenna control unit has a configuration function which can be accessed via an external control unit, wherein at least one functional element is deactivable and/or activable via the configuration function.

19 Claims, 3 Drawing Sheets

(56) References Cited

U.S. PATENT DOCUMENTS

| | | | | |
|---|---|---|---|---|
| 2012/0062356 | A1* | 3/2012 | Mann | H01Q 21/08 340/3.5 |
| 2013/0307728 | A1 | 11/2013 | Berger et al. | |
| 2016/0197484 | A1* | 7/2016 | Jost | G01D 21/00 307/116 |

FOREIGN PATENT DOCUMENTS

| | | | |
|---|---|---|---|
| DE | 102014011822 | A1 | 2/2016 |
| EP | 2375499 | A1 | 10/2011 |
| WO | 2009121127 | A1 | 10/2009 |

* cited by examiner

ANTENNA

CROSS-REFERENCE TO RELATED APPLICATION

This application claims priority to German Patent Application No. 10 2016 001 912.3, entitled "Antenna," filed Feb. 18, 2016, the entire contents of which are hereby incorporated by reference for all purposes.

TECHNICAL FIELD

The present disclosure relates to an antenna comprising an antenna control unit, a plurality of radiators and a plurality of functional elements. The antenna is, in particular, a mobile communication antenna, especially for a mobile communication base station, i.e. a mobile communication antenna by means of which mobile communication signals can be received and transmitted at a mobile communication base station.

BACKGROUND AND SUMMARY

Many mobile communication antennas allow a change of the tilt angle of the phased arrays defined by the radiators. This is normally done by adjusting a phase difference between the individual radiators of the phased array. To this end, the radiators of the phased array are normally connected to the respective ports via a phase shifter. Antennas are already known, in the case of which this adjustment can take place via an external control unit. To this end, the antenna may comprise a communication interface, which is normally an AISG interface. Such an interface allows, on the one hand, a control of the tilt angle via an external control unit. On the other hand, the communication interface also allows reading of the data of the antenna, such as the serial number, etc.

Communication with the external control unit may, according to a first variant, take place via a separate cable connecting the antenna control unit to the external control unit. In this case, servicing staff may e.g. connect the external control unit to the antenna control unit on site for adjusting the tilt angle.

In addition, the communication interface may allow communication with the external control unit via the high-frequency lines connected to the ports of the radiators. To this end, the communication signals of the communication interface have superimposed thereon the mobile communication signals transmitted on the high-frequency lines. The separation of the received communication signals and the superposition of the transmitted communication signals may take place via an interface referred to as bias tee and arranged in the high-frequency lines. This kind of communication allows the antenna control unit to be accessed via an external control unit arranged in the area of the base station or integrated in the base station. This external control unit can, in turn, be accessed by the operator of the mobile communication base station.

In this context it is also known that a plurality of base stations share an antenna, i.e. that different ports of the antenna are connected to different base stations. The base stations are then capable of separately adjusting the tilt angle of each of the radiators associated therewith.

The mobile communication antennas here normally comprise a plurality of different radiators for transmitting and/or receiving in a plurality of frequency bands, said radiators being connected to the mobile communication base station via separate ports of the antenna.

Depending on the customer's demands, such antennas are therefore produced with different equipment comprising radiators for e.g. three, four or five different frequency bands. This results in a high number of production variants. If an operator wants to enlarge the base station by additional frequency bands later on, or if there is a further operator who wants to utilize the antenna as well, the installed antenna will have to be replaced by an antenna suitably equipped with additional radiators.

Such mobile communication antennas produced by the applicant are described e.g. in the publication KATHREIN, Remote Electrical Tilt System, Overview of Related Products, Installation and Control Possibilities, Edition January 2014. DE 10 2011 009 600 B3 additionally shows a mechanical switching device through which a plurality of phase shifters of such a mobile communication antenna can be driven by only one drive.

It is the object of the present disclosure to provide an antenna through which the manufacturing costs and the operating costs can be reduced and/or which can be used in a more flexible manner.

According to the present disclosure, this object is achieved by an antenna comprising an antenna control unit, a plurality of radiators and a plurality of functional elements, the antenna control unit having a configuration function which can be accessed via an external control unit, wherein at least one functional element is deactivable and/or activable via the configuration function. Further developments of the present disclosure are the subject matter of the dependent claims.

The present disclosure shows an antenna comprising an antenna control unit, a plurality of radiators and a plurality of functional elements. The antenna control unit has a configuration function, which can be accessed via an external control unit. According to the present disclosure, at least one functional element is deactivable and/or activable via the configuration function. The antenna according to an embodiment of the present disclosure is a mobile communication antenna, in particular for a mobile communication base station.

Through the configuration function according to the present disclosure, the antennas need no longer be equipped with different numbers of functional elements, depending on the specific demands of the operator. On the contrary, all the antennas can be produced such that they are fully equipped with functional elements within the framework of the production. If an operator should only need part of the functional elements, only a respective subgroup of functional elements will initially be activated ex factory. If, in the course of the service life of the antenna, the operator should need further functional elements, the latter can additionally be activated via the configuration function. Vice versa, functional elements which are no longer required can be deactivated, if desired. In view of the fact that the configuration function can be accessed via an external control unit, it will easily be possible to reconfigure the antenna and to activate and/or deactivate the individual functional elements. It follows that, due to the reduced number of variants, the present disclosure allows a cost-effective production of the antennas as well as an extremely flexible adaptation of the antennas to the needs of the operator. In particular, the antenna can be extended by activating functional elements and need no longer be replaced by another antenna, as has been the case in the prior art.

The functional elements may especially be hardware elements with which the antenna is equipped. Thus, a plurality of antennas can be equipped with the same hardware in an advantageous manner, and can then be adapted to the operator's needs via the configuration function of the antenna control unit.

According to a first embodiment of the present disclosure, the functional elements comprise ports through which the radiators of the antenna have signals supplied thereto. At least one port is deactivable and/or activable via the configuration function. A plurality of ports may optionally be selectively deactivable and/or activable via the configuration function.

The ports may be terminals of the antenna, which are adapted to have connected thereto cables for supplying signals to the radiators of the antenna. Optionally, these terminals are high-frequency terminals, which are adapted to have connected thereto high-frequency cables connecting the antenna to the base station.

According to a possible embodiment of the present disclosure, a plurality of radiators of the antenna may be interconnected to form at least one phased array. In particular, the radiators may be interconnected via a phase shifter so as to form a phased array, so that the tilt angle of the phased array is adjustable by adjusting the phase shifter. The radiators of a phased array may comprise at least one common port, which is deactivable and/or activable through the configuration function.

In addition, the radiators may be dual-polarized radiators. Such a radiator may have associated therewith two ports in this case. Optionally, a plurality of dual-polarized radiators are here interconnected to form a dual-polarized phased array, in the way described hereinbefore. Such a phased array has thus two ports, one for each of the two polarizations. These two ports of a phased array may be deactivable and/or activable through the configuration function.

According to a possible embodiment of the present disclosure, the respective two ports of a dual-polarized radiator and/or of a dual-polarized phased array are deactivable and/or activable in common. Hence, the two ports of such a dual-polarized radiator and/or of such a dual-polarized phased array are no longer activable and/or deactivable separately, but only in common. However, normally the two ports of such an antenna are not needed separately. The investment in circuit technology required for deactivating and/or activating a dual-polarized radiator and/or a dual-polarized phased array is reduced in this way.

According to another advantageous embodiment, the antenna according to the present disclosure comprises ports and radiators and/or phased arrays connected to these ports and used for transmitting and/or receiving in different frequency bands. In particular, the antenna according to the present disclosure may comprise radiators and phased arrays, respectively, with different center frequencies.

In particular, the antenna may comprise ports and/or radiators for more than three, optionally more than four frequency bands. The antenna is here e.g. a pentaband antenna, i.e. an antenna with ports for five different frequency bands. According to a possible embodiment, the antenna may comprise at least one phased array for each frequency band.

The number of frequency bands with which the antenna can be operated may be changed by deactivating and/or activating ports of the antenna. In particular, the antenna may comprise ports and/or radiators for more than three, optionally more than four frequency bands, the ports being deactivable and/or activable for at least one and optionally for more than one frequency band.

It follows that, if an operator of a base station initially only needs ports for a smaller number of frequency bands, the antenna will be delivered with a configuration in which the other ports have been deactivated. If the operator, or some other operator, should need additional frequency bands while operating the antenna, the initially deactivated ports can be activated via the configuration function.

Furthermore, the antenna may comprise a plurality of phased arrays for respective individual frequency bands or for all frequency bands. In particular, the antenna may comprise a plurality of phased arrays for at least one frequency band, the ports of at least one and, optionally, of a plurality of these phased arrays being deactivable and/or activable.

This kind of configuration comprising a plurality of phased arrays for the same frequency band thus allows an increase of the capacity of the antenna in a frequency band by activating a further phased array, e.g. for allowing a plurality of base stations to be connected to the same antenna.

The antenna may comprise one or a plurality of radiators and/or phased arrays whose ports are not deactivable and/or activable. Hence, these radiators and/or phased arrays constitute the basic equipment of the antenna. In addition, the antenna comprises, however, one or a plurality of radiators and/or phased arrays whose ports are deactivable and/or activable and can therefore be deactivated and/or activated for changing the functional range of the antenna.

A plurality of radiators and/or phased arrays of the antenna may be arranged in a single antenna housing. Optionally, the ports comprise connection elements used for connecting high-frequency cables and consisting e.g. of bushings arranged on the housing. Optionally, the housing also has provided therein phase shifters for adjusting the tilt angle of the phased arrays.

The radiators of a phased array may be arranged vertically one above the other in a column. In addition, a plurality of such columns of radiators may be arranged side-by-side. Furthermore, the radiators of different frequency bands may be nested. The radiators may be arranged on a common support structure. The support structure may especially be a reflector that is common to the radiators.

According to a possible embodiment of the present disclosure, at least one switch, which is mechanically shiftable from a first switching position to a second switching position, is provided for deactivating and/or activating the ports. Such a mechanical switch allows simple switching of high-frequency signals. According to the present disclosure, the shifting of the switch is controllable via the antenna control unit, and said shifting of the switch can be accessed in particular by the configuration function.

Optionally, the switch deactivates the port at the first switching position, whereas the port connects to at least one radiator at the second switching position.

According to a possible embodiment of the present disclosure, two shiftable switches are mechanically coupled to one another and/or integrated in one another and can only be shifted in common. Optionally, such two switches serve to activate and/or deactivate the two ports of a dual-polarized radiator and/or of a dual-polarized phased array. In particular, the two switches may deactivate the two ports at the first switching position and connect the ports to the dual-polarized radiator and/or the dual-polarized phased array at the second switching position.

In the following, possible embodiments of a switch of the type adapted to be used according to the present disclosure for deactivating and/or activating a port will be described in more detail. If a plurality of switches is used, optionally several switches and, further optionally, all the switches will be configured as described hereinafter.

The switch may comprise a rotatably supported pickup which, at the first switching position, separates a connection to a first signal line and, at the second switching position, establishes a connection to a first signal line. The first signal line may here be connected to a first line section of the switch, which, at the second switching position, capacitively couples via a dielectric layer to a line section of the pickup. Optionally, the first signal line connects here the switch to a radiator.

Furthermore, the pickup may be electrically, in particular capacitively, coupled to a second signal line via a coupling point arranged in the area of its axis of rotation. Optionally, this second signal line is here connected to the port.

In addition, the pickup may, at the first switching position, establish a connection to a termination, in particular in that the pickup capacitively couples, at the first switching position, to a second line section of the switch, which is connected to a termination.

For realizing such a termination, there are a plurality of possibilities: for example, a 50Ω termination may be used. Through suitable adaptation, no reflection will occur. Optionally, short-circuiting may be used as a termination. Due to the short-circuited line, a total reflection will occur. As a further alternative, an open line may be used as a termination. The open end may be shielded so as to prevent interaction with the antenna. Also this leads to a total reflection at the open end.

Through the termination according to the present disclosure, a deactivated port can be identified by the base station. In particular, this will lead to triggering of a VSWR alarm, when the base station is connected to a deactivated port and when the latter has power supplied thereto.

According to the present disclosure, the termination may be integrated in the switch or configured as a separate component, which is connected to the switch, in particular in case that the termination is provided by the end of a cable.

The switch may comprise a closed housing. Said housing may consist e.g. of an electrically conductive material or it may be coated with such a material.

The switch according to the present disclosure may be operated via an electrically controllable actuator. In particular, the actuator may therefore be an electromechanical actuator. The actuator used may e.g. be an electromechanical linear actuator and/or an electric motor, in particular an electric motor having a transmission.

The switch may be operated via an actuator, which is also used for adjusting at least one phase shifter of the antenna. This is advantageous insofar as no additional actuator will be required for shifting the switch, but an actuator can be used, which is required for adjusting a phase shifter anyhow.

According to a possible embodiment of the present disclosure, the antenna may comprise a plurality of phase shifters, which are adapted to be adjusted via a single actuator. Optionally, the actuator is selectively connectable via a changeover arrangement to one of the phase shifters so as to adjust the latter.

The changeover arrangement may comprise a plurality of separate output elements for adjusting the phase shifters, wherein each of the output elements is connected to at least one of the phase shifters via a respective driving mechanism.

The actuator and/or the changeover arrangement may, according to the present disclosure, also used for operating one or a plurality of switches for deactivating and/or activating ports.

The changeover arrangement and/or the driving mechanism, which connects the changeover arrangement to the face shifters, may here be configured in the way shown in DE 10 2011 009 600 B3, which is owned by the same applicant. The content of this application is referred to in its entirety.

According to first variant of the present disclosure, the switch and the at least one phase shifter can jointly be shifted by means of a common driving mechanism, which is operated by the actuator. Optionally, the switch and the at least one phase shifter may be associated with the same group of radiators. In particular, the switch may be used for activating and/or deactivating a phased array defined by a group of radiators, whereas the phase shifter, which is operated by the switch via the common driving mechanism, is used for adjusting the tilt angle of the phased array. According to a possible embodiment, the driving mechanism is driven by an output element of the above-described changeover arrangement.

The common driving mechanism may shift the switch between the first and the second switching position in a first adjusting range and may adjust the phase shifter in a second adjusting range. A first adjusting range of the driving mechanism thus serves to operate the switch, and a second one serves to adjust the tilt angle.

The connection between the driving mechanism and the switch may comprise a freewheeling range in the second adjusting range, so as to adjust the phase shifter by further operating the driving mechanism, without operating the switch. The freewheeling range thus ensures that the switch will remain at the second switching position, at which the port is activated, while, through shifting of the driving mechanism in the second adjusting range, the tilt angle is changed by adjusting the phase shifter.

Furthermore, the connection between the driving mechanism and the phase shifter may comprise a freewheeling range in the first adjusting range, so as to shift the switch by operating the driving mechanism. This freewheeling range ensures that a further adjustment of the phase shifter is prevented, while the port is being deactivated by operating the switch.

Alternatively, the phase shifter may, however, also be adjusted together with the switch in the first adjusting range. In this case, the phase shifter has an adjusting range, which—though it cannot be used for changing the tilt angle of the activated radiators, but is only passed over when the switch is being shifted from the second switching position to the first switching position—allows to dispense with the use of a freewheel.

The common driving mechanism may e.g. be a push rod, which is connected to the switch as well as the phase shifter via eccentrics and/or catches. Alternatively, the driving mechanism may be a gear unit connecting an output shaft to the switch as well as to the phase shifter.

If, as described hereinbefore, a changeover arrangement is used for allowing a plurality of phase shifters to be adjusted via the same actuator, the switch and the phase shifter are optionally connected to the same output element of the changeover arrangement according to the above described embodiment. Hence, the use of the switch does not necessitate any additional output elements on the changeover arrangement.

According to a further embodiment of the present disclosure, the switch and the phase shifter or face shifters can each be shifted by a separate driving mechanism. Optionally, these driving mechanisms are selectively connectable to the actuator via a changeover arrangement. In this case, a switch and a phase shifter, which are associated with the same group of radiators, can thus be shifted via separate driving mechanisms.

It follows that shifting of the switch and of the phase shifter necessitates that the changeover arrangement is switched over between the respective output elements. In particular, the driving mechanism for the switch and the driving mechanism for the phase shifter are here coupled to separate output elements of the changeover arrangement. This simplifies the driving mechanism for the switch and the phase shifter, respectively, since freewheels are no longer required. The use of the switch, however, requires an additional output element on the changeover arrangement.

According to a further embodiment of the present disclosure, the functional elements may comprise communication interfaces for communication between the antenna control unit and an external control unit, at least one and optionally a plurality of the communication interfaces being selectively deactivable and/or activable through the configuration function. Also this allows the antenna hardware to be delivered fully equipped with communication interfaces ex factory. The communication interfaces that are not required by the operator are, however, initially deactivated and will only be activated when they are actually needed.

An activated communication interface may allow controlling of the tilt angle of at least one phased array of the antenna and/or reading of antenna data.

The communication interfaces may e.g. be AISG interfaces. AISG is a standardized protocol for communication with an antenna control unit.

According to a possible embodiment, the communication interfaces are associated with the ports of the antenna and allow communication via the signal lines used for transmitting the signals to the radiators. Hence, the high-frequency lines used for transmitting the signals, in particular the mobile communication signals, to the radiators may simultaneously also be used for transmitting the data signals for communication with the antenna control unit. In particular, the communication interfaces may each comprise a bias tee, which separates the mobile communication signals and the communication data from one another.

According to a possible embodiment of the present disclosure, the communication interfaces may be integrated in the ports of the antenna, so that, by connecting a high-frequency line to a port of the antenna, communication with the communication interface integrated in the port can take place as soon as said communication interface has been activated. Other than in the case of conventional bias tees, it is no longer necessary to specially to incorporate these bias tees into the high-frequency line, but they are already integrated in the ports of the antenna.

According to a possible embodiment, one or a plurality of communication interfaces may, however, also have a separate connection by means of which it is/they are connectable to an external control unit by cable. In particular, the connection may here exclusively be used for communication with the antenna control unit.

Furthermore, the antenna control unit may comprise a control matrix that determines which components of the antenna can be accessed via which communication interface. The control matrix may be configurable through the configuration function. According to a possible embodiment of the present disclosure, the antenna comprises a plurality of phased arrays, which, depending on the configuration of the control matrix, can be accessed separately via different communication interfaces and/or in common via one communication interface. According to a possible configuration of the control matrix, a plurality of phased arrays can thus be accessed via only one communication interface and, in particular, the tilt angle of these phased arrays can be adjusted and/or the data thereof can be read. According to an alternative configuration of the control matrix, however, respective separate communication interfaces may be configured such that only one or a plurality of phased arrays, which are associated therewith, can be accessed via said communications interfaces, whereas other phased arrays, which are associated with some other communication interface, cannot be accessed.

The functional elements of the antenna may comprise ports, through which the radiators of the antenna have signals supplied thereto, and communication interfaces, at least one port and at least one communication interface being deactivable and/or activable by the configuration function. The communication interface may be associated with the port.

The port may be activated independently of the activation of the communication interface. Thus, it is especially possible to activate a port, whereas the communication interface associated therewith remains deactivated. Optionally, the above-mentioned control matrix can be configured in this case such that an antenna, which has supplied thereto signals via an activated port, whereas the communication interface associated with the port is deactivated, can be accessed via some other communication interface. Furthermore, deactivation of a communication interface can take place independently of the deactivation of the port associated therewith.

Optionally, a communication interface can only be activated when the port associated therewith has been activated as well. According to an alternative embodiment, deactivation and activation of the communication interfaces can take place independently of the deactivation and the activation of the ports.

The control matrix may be configured such that radiators or phased arrays which are associated with a deactivated port cannot be accessed via any of the communication interfaces.

The antenna according to the present disclosure may comprise a plurality of ports and a plurality of communication interfaces that are deactivable and/or activable by the configuration function. The communication interfaces may be associated with the respective ports. The ports may be activated independently of the activation of the communication interfaces.

According to a further embodiment of the present disclosure, the functional elements comprise at least one sensor which is deactivable and/or activable by the configuration function. Hence, the antenna can be equipped with such a sensor, irrespectively of whether the operator actually needs a sensor. If the sensor is actually required, it can be activated.

According to a possible embodiment of the present disclosure, different data of the sensor can selectively be deactivable and/or activable, and/or the data of different sensors can selectively be deactivable and/or activable. Depending on the concrete wishes of the operator, different data can thus be made available through activation. Optionally, the data can be read by means of the external control unit. To this end, the external control unit is able to communicate with the antenna control unit.

The sensor or sensors may especially be a tilt sensor and/or a position sensor and/or a temperature sensor and/or a humidity sensor. The data of a tilt sensor and/or position sensor may especially be used when an antenna is being installed and/or when the correct installation of an antenna is checked. The data of a temperature sensor and/or a humidity sensor may e.g. be used for weather forecasting.

The configuration function of the antenna control unit according to the present disclosure may e.g. be implemented via a configuration file, which is stored in the antenna control unit and which can be changed through the external control unit. The change of configuration and consequently the activation and/or deactivation of functional elements is thus effected via a software update, within the framework of which the configuration file is changed.

Optionally or additionally, the configuration function may comprise an authentication function, which prevents unauthorized deactivation and/or activation of the functional elements. In this way, it is guaranteed that only authorized operators will be able to access the configuration of the antenna. The authentication function may here work with software signatures and/or software keys.

Furthermore, the antenna control unit may, alternatively or additionally, comprise a communication interface via which the external control unit can access the configuration function.

According to a possible embodiment, at least one communication interface may be provided, via which the external control unit is able to access the configuration function and which cannot be deactivated and/or is not associated with any port. Optionally or additionally, at least one communication interface may be provided, via which the external control unit is able to access the configuration function, said communication interface having a separate connection. Optionally or additionally, there is furthermore an external control unit that is able to access the configuration function via all the activated communication interfaces.

An antenna according to the present disclosure may be connected to one or a plurality of base stations, so as to transmit and receive mobile communication signals. If the antenna is connected to a plurality of base stations, the latter may be operated by the same service provider, but also by different service providers.

The antenna according to the present disclosure may be a passive antenna, i.e. the antenna does not comprise any amplifier arranged between the ports and the radiators. According to a possible alternative embodiment, the antenna according to the present disclosure may, however, also be an active antenna.

The present disclosure comprises a base station array comprising at least one base station and at least one antenna of the type described hereinbefore. The at least one base station is connected to at least one port of the antenna according to the present disclosure, optionally via a high-frequency cable.

According to a possible embodiment, at least a first and a second base station are provided, each of which is separately connected to respective ports of the antenna. Optionally, different phased arrays arranged in the antenna are separately supplied with mobile communication signals via the first and the second base station.

According to a further possible embodiment, the first and the second base station communicate with the antenna control unit via separate communication interfaces of the antenna. Optionally, the first and second base station can only access the radiators and/or phased arrays of the antenna, which are associated with said base station and have mobile communication signals supplied thereto by said base station. Optionally, the communication interfaces are associated with the ports. In particular, this structural design allows at least a first and a second service provider to use the antenna in common.

The present disclosure additionally comprises a method of operating an antenna or a base station array of the type described hereinbefore. In particular, the method serves to transmit and/or receive mobile communication signals. The method comprises the following steps:

- operating the antenna making use of a first subgroup of functional elements, in particular a first subgroup of ports and/or communication interfaces,
- accessing the configuration function of the antenna and activating a second subgroup of functional elements of the antenna, in particular via an external control unit,
- operating the antenna making use of the first and of the second subgroup of functional elements.

It follows that, making use of the method according to the present disclosure, the configuration can be changed, during operation of the antenna, such that additional functional elements can be utilized.

In particular, additional ports and/or additional communication interfaces can be activated. Optionally, the additional ports are used for transmitting and/or receiving in an additional mobile communication frequency band. Optionally or additionally, a further base station can be connected to the second subgroup of functional elements, in particular to the additional ports. Further alternatively or additionally, additional communication interfaces can be activated.

According to a possible embodiment of the present disclosure, the communication interfaces may each have a ping function, which allows to measure the signal transit time between the external control unit and the communication interface.

The external control unit may e.g. be a portable device, which is connected, on site, to the respective terminal of the antenna via a cable or, in a wireless fashion, via a respective communication interface. In particular, the external control unit may here be an antenna line device. The external control unit may, alternatively or additionally, communicate with the antenna control unit via the mobile communication base station.

According to a possible embodiment, communication between the external control unit and the antenna control unit may take place via a cable, which is exclusively used for communication between the antenna control unit and the external control unit.

Alternatively or additionally, communication between the external control unit and the antenna control unit may take place via communication signals, which, together with the mobile communication signals, are exchanged on the high-frequency cables provided between the base station and the antenna.

The present disclosure will now be explained in more detail making reference to embodiments as well as drawings. The figures are drawn to scale, although other relative dimensions may be used, if desired.

DETAILED DESCRIPTION

Figure 1:
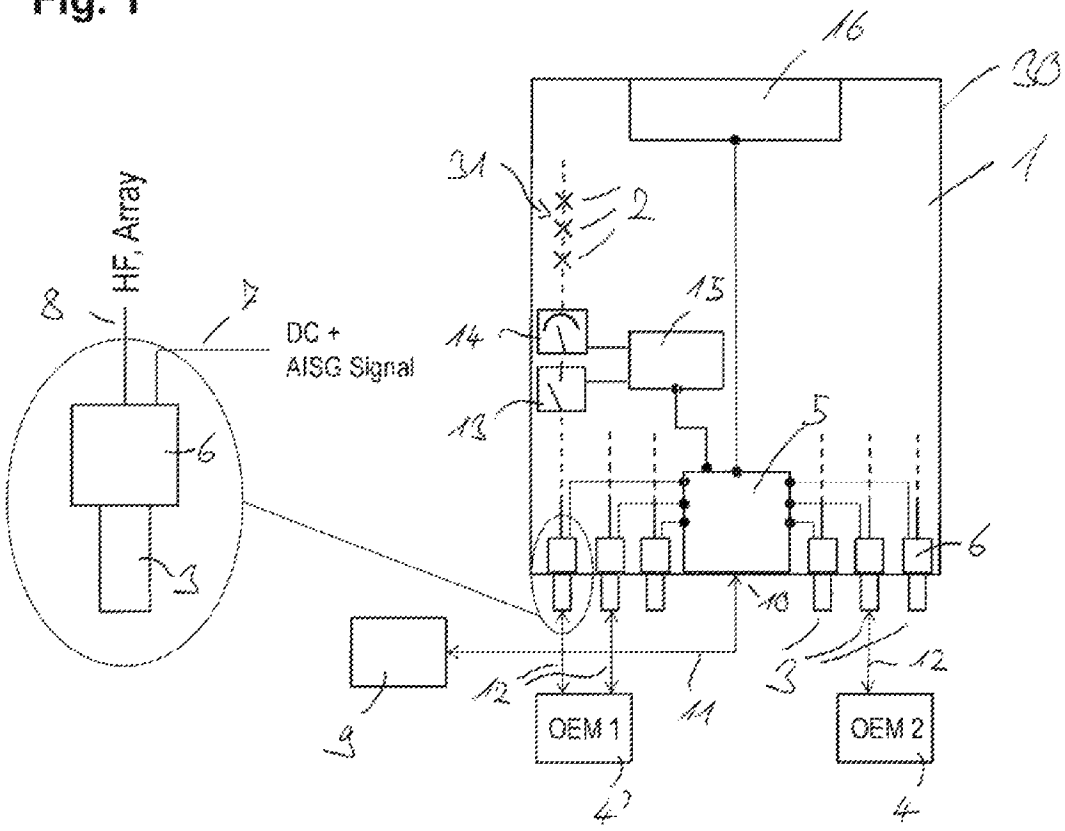
FIG. 1 shows an embodiment of a base station array according to the present disclosure comprising an antenna according to the present disclosure.

FIG. 1 shows an embodiment of a base station array according to the present disclosure, in which an embodiment of an antenna 1 according to the present disclosure is used. The antenna 1 comprises a plurality of radiators 2 connected to base stations 4 and 4' via ports 3 of the antenna 1 and high-frequency lines 12. The antenna receives high-frequency transmit signals from the base stations and transmits them via the radiators 2. Vice versa, the radiators 2 receive mobile communication signals from terminal devices.

The antenna 1 comprises a housing having the radiators 2 arranged in the interior thereof. The housing 30 has provided thereon the ports 3, which are configured as bushings for connection to the high-frequency cables.

Figure 2:
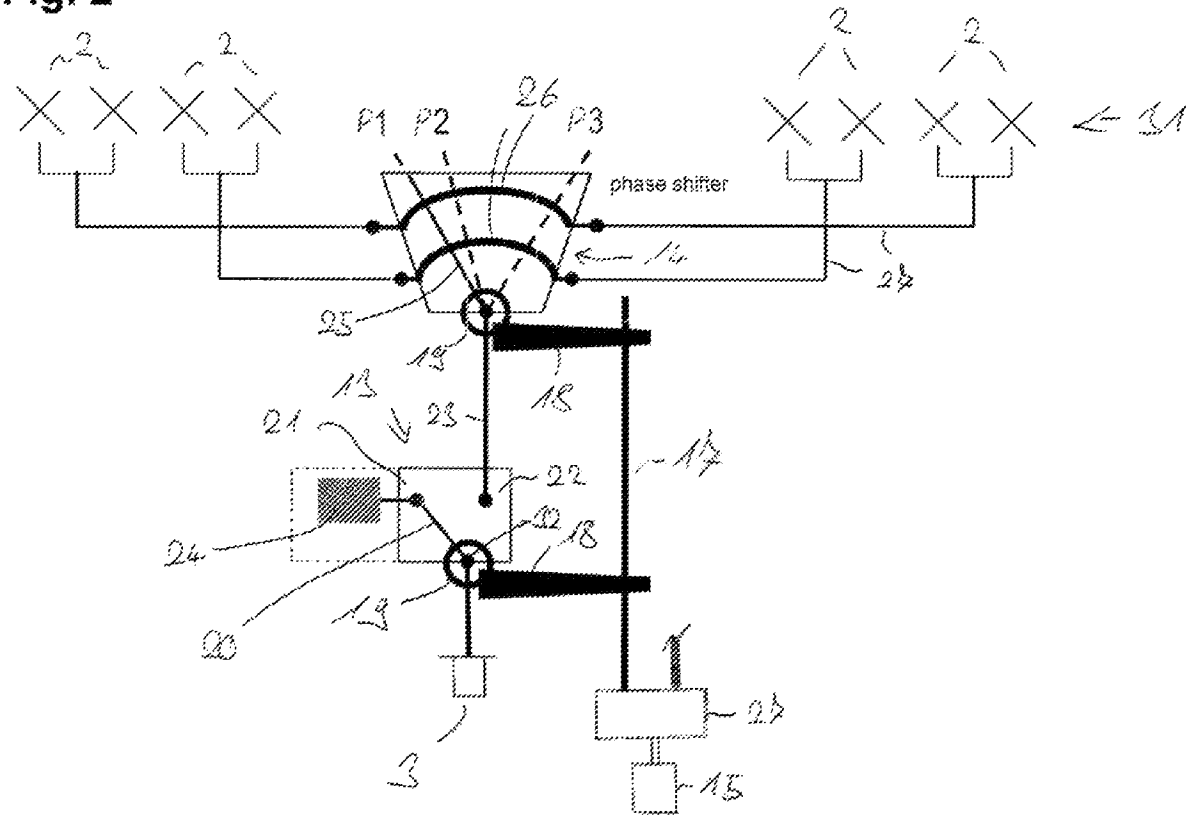
FIG. 2 shows a first embodiment of a switch according to the present disclosure for activating and/or deactivating a functional element, wherein the switch is operable together with a phase shifter via a common driving mechanism.

As is schematically shown in FIGS. 1 and 2, a respective plurality of radiators 2 are combined to form a phased array 31 in the present embodiment. The individual radiators 2 of such a phased array 31 are supplied with mobile communication signals via a common port 3. The radiators of the phased array 31 are here optionally arranged one above the other in at least one vertical column. In order to adjust the tilt angle of the phased array 31, the individual radiators of the phased array are connected to the port via one or a plurality of phase shifters 14. By adjusting the phase difference between the individual radiators of the phased array, the tilt angle of the antenna can be adjusted electrically.

The radiators 2 are dual-polarized radiators in the present embodiment. Hence, one respective radiator has associated therewith two separate ports for its two polarizations. Likewise, a phased array 31 has thus associated therewith two ports for the two polarizations of the radiators defining the phased array. It follows that the term port in the sense of the present disclosure means the connection of a radiator or of a group of radiators combined so as to form a phased array.

The antenna 1 comprises an antenna control unit 5 via which the adjustment of the tilt angle of the phased arrays can be controlled. In the present embodiment, the antenna comprises at least one electromotive actuator 15, which, via one or a plurality of driving mechanisms, is connected to the phase shifters so as to adjust the same. The actuator 15 is controlled by the antenna control unit 5.

The antenna control unit 5 comprises a communication interface 10 through which it can be connected to an external control unit 9.

In the embodiment shown in FIG. 1, the connection between the external control unit 9 and the antenna control unit 5 is established via a cable 11. In the present embodiment, the external control unit 9 is an antenna line device. The communication interface used is an AISG interface. In particular, the antenna control unit 5 comprises an AISG bushing via which it can be connected to the external control unit 9. Alternatively, the antenna control unit 5 and the external control unit 9 may also communicate in a wireless fashion, e.g. via known wireless interfaces, such as ZigBee, Bluetooth or WiFi.

Further alternatively or additionally, the antenna control unit 5 and the external control unit 9 may, however, also communicate via the high-frequency cables. The respective communication interfaces will be explained in more detail hereinafter. Furthermore, the external control unit may also be integrated in the base station 4 and/or 4', and/or it may allow remote maintenance.

In the present embodiment, the antenna 1 comprises a plurality of phased arrays 31 for different mobile communication frequency bands. For example, the antenna may here comprise phased arrays for three, four or five mobile communication frequency bands. According to possible embodiments, the antenna may comprise only one phased array per mobile communication frequency band, in the case of other embodiments it may, however, also comprise two or more phased arrays for the same mobile communication frequency band.

The radiators 2 of the antenna and the ports 3, respectively, via which the radiators 2 have mobile communication signals supplied thereto, define functional elements of the antenna according to the present disclosure.

The antenna according to the present disclosure comprises, as additional functional elements, a plurality of communication interfaces 6, which allow communication with the antenna control unit 5.

According to a possible, not-shown embodiment of the present disclosure, these additional communication interfaces may be configured in the same way as the communication interface 10 and comprise a bushing via which a cable serving the sole purpose of communication with the communication interface can be connected to the antenna control unit 5.

In the embodiment shown in FIG. 1, communication with the communication interfaces 6, however, takes place via the high-frequency signal lines 12 connected to the ports 3.

As shown in FIG. 1 in the enlarged representation on the left-hand side, the communication interface 6 separates the signals applied via the high-frequency signal lines 12 on the one hand into the high-frequency mobile communication signals, which are transmitted to the radiators 2 via the high-frequency signal line 8, and on the other hand into the communication signals, which are transmitted to the antenna control unit 5 via the communication signal line 7. Vice versa, the communication signals coming from the antenna control unit 5 are superimposed on the high-frequency signals coming from the radiators. By way of example, the communication signals may here be modulated onto a carrier frequency in the communication interface 6 for transmission via the high-frequency signal lines 12, said carrier frequency lying outside the mobile communication frequency range.

The communication interfaces may in particular be AISG interfaces. As described above, the interfaces may optionally be configured as bias tees, i.e. they allow communication via the high-frequency signal lines 12.

In the embodiment shown in FIG. 1, the communication interfaces are integrated in the ports 3 of the antenna, i.e. no separate pickups arranged in or on the high-frequency signal lines are necessary for establishing communication, but the communication interfaces are already part of the antenna. Thus, it will suffice to connect the high-frequency signal lines 12 to the ports 3 for allowing also communication with the communication interfaces 6 of the antenna. The fact that, according to the present disclosure, the communication interfaces 6 are integrated in the ports 3 does not necessarily mean that the bias tee must be arranged directly in the area of the bushing for connection of the high-frequency lines. On the contrary, said bias tee may also be arranged at some other location within the antenna.

The antenna according to the present disclosure includes, as additional functional elements, a sensor arrangement 16 comprising at least one sensor. Also this sensor communicates with the antenna control unit 5.

According to the present disclosure, the antenna control unit 5 has a configuration function through which at least one functional element is deactivable and/or activable. The functional element may especially be a port 3, a communication interface 6 and/or a sensor 16. The configuration function thus allows the antenna to be manufactured and delivered with fully equipped hardware. If a customer should initially not need all the functional elements, the non-needed functional elements will be deactivated ex factory. Due to the configuration function according to the present disclosure, the functional elements can, however, be activated during further operation, so that the operator will be able to access the additional functional elements, after activation of the same, if he should need them during further operation. The possibility of activation additionally allows to enable e.g. a further operator to access functional elements that are not utilized by a first operator.

As regards hardware, the antenna may here e.g. be configured as a pentaband antenna with five frequency bands and ten ports. Among these five frequency bands, one or several frequency bands may, however, initially be deactivated. The antenna may e.g. be delivered as a triple band antenna with three frequency bands and, consequently, six activated ports. Later on, the remaining two frequency bands and thus the four remaining ports may be activated by the external control unit, if they should be needed.

Two embodiments illustrating how the ports can be deactivated and activated, respectively, will now be described in more detail with reference to FIGS. 2 and 3. In the case of both embodiments, the ports are enabled and disabled via a switch 13 that is switched via an electromechanical actuator 15.

In the present embodiment, the switch is arranged between the port 3 and the radiator or radiators, which have supplied thereto high-frequency signals from the port 3. In particular, the switch may be arranged between the port 3 and a phase shifter 14 via which a plurality of radiators 2 are interconnected to form a phased array.

The switch is a 1-to-2 switch, i.e. a switch which connects a first terminal 32 selectively to a second terminal 21 or a third terminal 22. The first terminal 32 communicates with the port 3, the third terminal 22 communicates with the radiators that have mobile communication signals supplied thereto by the port. At a first switching position, the switch deactivates the port 3, i.e. it disconnects the high-frequency signal connection between the port 3 and the radiator or radiators associated with this port. At the second switching position, however, the switch connects the port 3 to the radiator or radiators associated with this port.

The switch comprises a rotatably supported pickup 20 which, in the area of its axis of rotation, is electrically coupled, in particular capacitively coupled, to the first terminal 32. At the first switching position, a line section 20 of the pickup is electrically coupled, optionally again capacitively, to the second terminal 21. At the second switching position, however, a line section of the pick up 20 couples to the third terminal 22. Also this coupling is optionally of a capacitive nature. It follows that, by rotating the pickup 20 from the first to the second switching position, the electric coupling of the first terminal to the second terminal can be eliminated and an electric coupling to the third terminal can be established.

The structural design of the switch is thus similar to that known from phase shifters. Instead of the line sections, which are passed over by the pickup so as to change the phase shift, the switch, however, has two separate line sections, the first line section, which defines the second terminal 21, coupling to the pickup 20 at the first switching position, and the second line section, which defines the third terminal 22, coupling to the pickup at the second switching position, the first and the second line sections being electrically separated from one another. Switching of the switch is now effected by shifting the pickup from the first switching position to the second switching position.

The second terminal 21 of the switch is connected to a termination 24. The termination may be integrated in the switch or configured as an additional box built separately from the switch. By means of said termination, a base station will be able to detect, provided that it is in signal communication with a deactivated port and supplies power to the latter, via a VSWR alarm that a deactivated port is connected and has power supplied thereto. The base station is thus able to detect whether the ports connected to the base station are deactivated or activated.

For realizing the termination, there are in particular the following three possibilities:

a) 50Ω termination. Through suitable adaptation, no reflection will occur.
b) Short-circuiting, i.e. the signal line is short-circuited in the area of the termination. This leads to total reflection, which will generate the VSWR alarm.
c) Open line. The open line is optionally shielded so as to prevent interaction with the antenna. Also this will lead to total reflection at the open end and said total reflection will generate an VSWR alarm.

The switch is optionally accommodated in a closed housing. The housing is optionally made of metal or comprises a metallized layer.

Switching of the switch 13 takes place via a driving mechanism 17 in both embodiments, said driving mechanism 17 connecting the switch to an electromechanical actuator 15. The electromechanical actuator 15 is controlled via the antenna control unit to move the switch from the first to the second switching position or back to the first switching position and to thus activate or deactivate the port.

The driving mechanism used may e.g. be a push rod 17 moving, via a catch 18, an eccentric 19, which, in turn, is connected to the pickup 20. Alternatively or additionally, a gear unit may be used for shifting the pickup 20.

The phase shifter 14 also comprises a pickup arm 25, which, in the area of its axis of rotation, is electrically, in particular capacitively, connected to a first terminal. This terminal communicates with the third terminal 22 of the switch via the signal line 23. The phase shifter additionally comprises conductor sections 26 which couple capacitively to a conductor section of the pickup arm 25. The radiators 2 of a phased array are connected via signal lines 27 to both ends of such a conductor section 26. Depending on the position of the pickup arm, the length of the signal path to one terminal is reduced and that to the other terminal enlarged, or vice versa. The phase shift between the individual radiators of the phased array can be changed in this way. Optionally, the phase shifter comprises two or more conductor sections 26, each of them being separately connected to radiators. The conductor sections are optionally located at different distances from the axis of rotation of the pickup arm 25. Optionally, the conductor sections extend in an arcuate shape around the axis of rotation.

Also the phase shifter is optionally moved via an electromechanical actuator 15.

According to an embodiment of the present disclosure that is not shown, a respective separate electromechanical actuator 15 can be used for shifting the switch 13 and the phase shifter 14. Optionally, the same electromechanical actuator 15 is, however, used for shifting the switch as well as for shifting the phase shifter.

Figure 3:
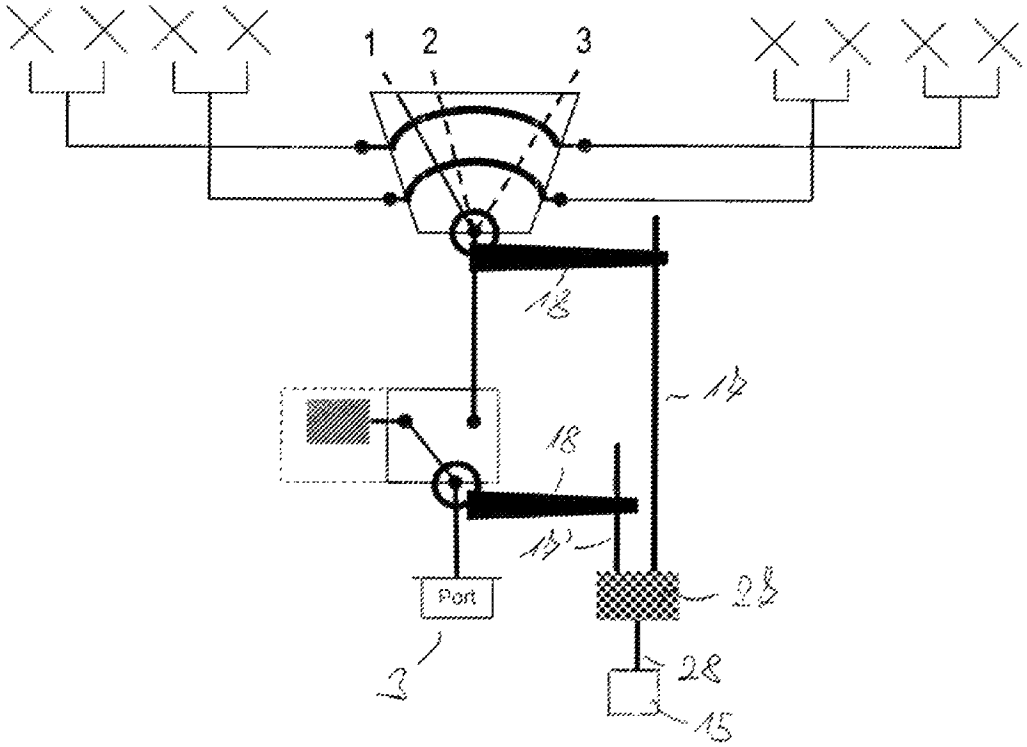
FIG. 3 shows a second embodiment of a switch according to the present disclosure for activating and/or deactivating a functional element, wherein the switch and a phase shifter associated therewith are operable by separate driving mechanisms.

FIGS. 2 and 3 show two embodiments illustrating how such shifting of the switch and of the phase shifter can be effected via only one electromechanical actuator.

In the embodiment shown in FIG. 2, the switch 13 and the phase shifter 14, which are associated with the same phased array 31, are connected to the drive 15 via a common driving mechanism 17. By way of example, a common push rod may be provided, which is coupled to eccentrics 19 of the phase shifter 14 and of the switch 13 via respective separate catches 18.

It follows that, by moving the common driving mechanism, in particular in the push rod 17, it will be possible to switch the switch 13 as well as to adjust the phase shifter 14. In particular, the switch can be switched in a first adjusting range, and the phase shift of the phased array 31 can be adjusted in a second adjusting range.

In the case of the embodiment shown in FIG. 2, the phase shifter is adjusted over the first as well as the second adjusting range. The position P1 is here an inoperative position, at which the switch 13 is open and the port is deactivated. If the switch is now shifted via the common driving mechanism 17 from the open position to the closed position, the phase shifter will simultaneously be shifted to the position P2. The position P2 thus constitutes the starting position of the utilizable range of the phase shifter, i.e. the minimum and the maximum tilt value, respectively.

By further operating the common driving mechanism, the tilt angle or tilt value can then be adjusted by shifting the phase shifter between the positions P2 and P3. The position P3 is the end position of the utilizable phase shifter range and represents thus the end tilt value, i.e. the maximum tilt value and the minimum tilt value, respectively.

While the phase shifter is being shifted in its utilizable range, i.e. between position P2 and position P3, the switch 13 remains at its second, closed switching position. In order to allow this, the connection between the common mechanism and the pickup arm 20 comprises a freewheeling range for this adjusting range.

According to a further embodiment, which is not shown in detail, also the phase shifter may be provided with a freewheel. In particular, the freewheel may be configured such that the pickup arm 25 of the phase shifter 14 is not moved while the switch is being shifted from its first, open switching position to its second, closed switching position. The whole adjusting range of the phase shifter from position P1 to position P3 can thus be used for adjusting the phase shift between the radiators.

According to a possible embodiment, the common driving mechanism 17 may be connected to the electromechanical actuator 15 via a changeover arrangement 27. The changeover arrangement may here comprise a drive shaft through which it is connected to the electromechanical actuator 15, as well as a plurality of output shafts, which are adapted to be selectively brought into operative connection with the drive shaft. The additional output shafts of the changeover arrangement 27 may be used for shifting additional switches and/or phase shifters of the antenna, so that the switches and/or phase shifters of a plurality of phased arrays of the antenna can be shifted via only one electromechanical actuator 15. Also the changeover arrangement 27 is here controlled by the antenna control unit 5. In particular, the changeover arrangement may be configured in the way known from DE 10 2011 009 600 B3.

FIG. 3 shows a further embodiment which differs from the embodiment shown in FIG. 2 only insofar as two separate driving mechanisms 17' and 17" are used for switching the switch on the one hand and for adjusting the phase shifter on the other, said driving mechanisms 17' and 17" being adapted to be alternatively connected to the electromechanical actuator 15. To this end, the two driving mechanisms 17' and 17" are connected to two separate output elements of the changeover arrangement 27, which has already been described hereinbefore. Also in this case, e.g. push rods, which are coupled via the catches 18 to eccentrics 19 of the switch and of the phase shifter, respectively, and/or gear units or lever arrangements may be used as driving mechanisms.

According to the embodiment shown in FIG. 2, only one output element of the changeover arrangement 27 is thus required for controlling the switch and the phase shifter of a phased array, the driving mechanism required being, however, slightly more complicated. According to the embodiment shown in FIG. 3, two separate output elements of the changeover arrangement 27 are, however, required for the switch and the phase shifter of a phased array 31, whereas the driving mechanisms may have a simpler structural design.

According to the present disclosure, the two ports associated with the orthogonal polarizations of a radiator and of a phased array, respectively, are optionally switched in common. To this end, the switches for the two polarizations may especially be mechanically coupled to one another and switched via the same driving mechanism. Likewise, also the phase shifters for the two polarizations may be coupled to one another and controlled via the same driving mechanism.

According to a possible embodiment, the two switches for the two ports of a phased array may be arranged in a stacked mode, the axes of rotation of the two switches being in alignment and the pickups being mechanically coupled to one another. Likewise, also the phase shifters may be arranged in a stacked mode, their axes of rotation being in alignment and being optionally mechanically coupled to one another.

The antenna according to the present disclosure may comprise one or a plurality of phased arrays, which are not adapted to be deactivated and which are directly connected to the ports without any intermediate switch being provided. This may in particular be the basic version of the antenna, which is normally used by any operator. One or a plurality of additional phased arrays are, however, deactivable and/or activable. However, according to an alternative embodiment also all the ports of the antenna may be deactivable and/or activable.

In addition to the deactivation and/or activation of ports, the configuration function of the antenna control unit 5 according to the present disclosure additionally allows the deactivation and/or activation of the communication interfaces 6 associated with the ports 3. In particular, the communication interfaces are standardly installed and active for this purpose. The antenna control unit 5, however, ignores and/or blocks the communication signals of non-activated communication interfaces. Especially, a communication between the antenna control unit 5 and non-activated communication interfaces is thus not possible and, consequently, in particular no adjustment of the phase shifters and no other data services.

The respective communication interfaces can, however, be activated through the configuration function, so that communication with the antenna control unit 5 will be possible via the respective communication interface.

The ports and the communication interfaces are here adapted to be activated independently of one another via the configuration function. In particular, a communication interface associated with an activated port can remain deactivated, or must be activated separately.

Furthermore, the antenna control unit may comprise a matrix that determines which phased arrays 31 can be accessed via which communication interfaces. In particular, it can be determined via the matrix that a plurality of phased arrays can be accessed via a communication interface, i.e. that in particular the tilt angles of a plurality of phased arrays can be adjusted via a common communication interface and/or that the respective antenna data for a plurality of phased arrays can be read via a common communication interface. Alternatively or additionally, it can be determined through the matrix that, via a first communication interface, exclusively a first subgroup of radiators or phased arrays of the antenna can be accessed, and that, via a second communication interface, exclusively a second subgroup of radiators or phased arrays can be accessed. Thus, the antenna can, as shown in FIG. 1, be used simultaneously by two base stations 4 and 4', especially also in cases where the base stations are operated by different service providers. In particular, the respective service providers will be able to control through the matrix the respective radiators or phased arrays, which are associated with their base station, such as if the antenna had no additional radiators and/or phased arrays. Hence, one base station will not see the other base station.

The adjustment determining which radiators and/or antennas can be accessed via which communication interface takes here place through a suitable configuration of the matrix via the configuration function.

Due to the possibility of controlling a plurality of phased arrays via a communication interface, an operator may possibly not need an activated communication interface for each activated port. Therefore, the communication interfaces of additionally activated ports may, in principle, remain deactivated.

The communication interfaces may have a ping function, which allows to measure the transit time of the communication signals and/or of the mobile communication transmit signals. Hence, it may be of advantage to have an activated communication interface for all the ports. If an operator should therefore need additional communication interfaces, the latter can be activated separately through the configuration function.

As an additional functional element also the sensor 16 or one of the sensors of the sensor arrangement 16 can be activated and/or deactivated according to the present disclosure. If an operator should therefore need additional sensor information, said sensors can be activated through the configuration function. The sensor may here be e.g. a tilt sensor and/or a position sensor. Alternatively or additionally, a temperature sensor and/or a humidity sensor may be provided. By way of example, only the position sensor may be activated. If additional data are required, also the remaining sensors and/or data sets may be activated. Additional service features of the sensor can thus be activated and also deactivated through the configuration function.

Irrespectively of which functional elements can be activated and/or deactivated through the configuration function, the activation and/or deactivation of functional elements may be executed via a software update of the software of the antenna control unit. By way of example, the configuration function may be implemented via a configuration file according to a possible embodiment, said configuration file being stored in a memory of the antenna control unit 5 and read from the antenna control unit. Respective changes of the configuration can thus be effected through a change or a replacement of the configuration file.

The configuration file may comprise all the information required for the configuration of the antenna, i.e. in particular information on the activated and/or deactivated ports, communication interfaces and/or sensors. Furthermore, the configuration file may also comprise the configuration of the matrix, i.e. the association of the communication interfaces with the radiators and/or the phased arrays.

However, the activation and/or deactivation of functional elements may, in addition to the updating of the configuration file, also be implemented by software in some other way. The decisive aspect is that the configuration function can be accessed via the external control unit.

Optionally, the antenna control unit has implemented thereon an authentication function, which guarantees that the configuration function can only be accessed by authorized operators. To this end, in particular a software signature may be provided, which must be comprised in a configuration file, so that said file can be loaded onto the antenna control unit and/or taken into account by the latter.

The antenna control unit comprises in particular a microprocessor and a memory having a software program and/or the configuration file stored therein. The software program is optionally of such a nature such that, together with the configuration file, it configures the antenna and provides thus the configuration function according to the present disclosure.

Due to the structural design according to the present disclosure, a substantially smaller number of equipment lines is required for the hardware of the antenna, whereby the manufacturing costs are reduced by reducing the variety of variants. Furthermore, additional functional elements can be made available to the operators in a flexible manner and without exchanging the antenna, as soon as such functional elements are required.

The invention claimed is:

1. An antenna comprising an antenna control unit, a plurality of radiators, and a plurality of functional elements, the antenna control unit having a configuration function which is accessed via an external control unit, wherein at least one functional element is deactivatable and/or activatable via the configuration function, wherein the configuration function is implemented via a configuration file, which is stored in the antenna control unit and which is changed through the external control unit, and/or wherein the configuration function comprises an authentication function, which prevents unauthorized deactivation and/or activation of the functional elements, and/or wherein the antenna control unit comprises a communication interface via which the external control unit accesses the configuration function, wherein at least one communication interface is provided, via which the external control unit accesses the configuration function and which cannot be deactivated and/or is not associated with any port, and/or wherein the external control unit accesses the configuration function via all the activated communication interfaces.

2. The antenna according to claim 1, wherein the functional elements comprise ports through which the plurality of radiators of the antenna has signals supplied thereto, wherein at least one port is selectively deactivatable and/or activatable via the configuration function, and/or wherein the plurality of radiators of the antenna is interconnected to form at least one phased array, wherein at least one port of the phased array is deactivatable and/or activatable through the configuration function.

3. The antenna according to claim 2, wherein the at least one port is a plurality of ports, and wherein the plurality of radiators of the antenna is interconnected via a phase shifter.

4. The antenna according to claim 1, wherein the functional elements comprise communication interfaces for communication between the antenna control unit and the external control unit, wherein at least one of the communication interfaces is selectively deactivatable and/or activatable through the configuration function.

5. The antenna according to claim 4, wherein the communication interfaces are integrated in ports of the antenna, so that, by connecting a high-frequency line to a port of the antenna, communication with the communication interface integrated in the port takes place as soon as the communication interface has been activated, and/or wherein the antenna control unit comprises a control matrix that determines which components of the antenna are accessed via which communication interface, wherein the control matrix is configurable through the configuration function, wherein the antenna comprises a plurality of phased arrays which, depending on the configuration of the control matrix, are accessed separately via different communication interfaces and/or in common via one communication interface.

6. The antenna according to claim 4, wherein the communication interfaces are associated with ports of the antenna and allow communication via the signal lines used for transmitting the signals to the plurality of radiators, wherein each of the communication interfaces comprises a respective bias tee.

7. The antenna according to claim 1, wherein the functional elements comprise ports through which the plurality of radiators of the antenna has signals supplied thereto, and communication interfaces, wherein at least one port and at least one communication interface, which is associated with the port, are deactivatable and/or activatable by the configuration function, wherein the port is activated independently of the activation of the communication interface.

8. The antenna according to claim 1, wherein the functional elements comprise at least one sensor which is deactivatable and/or activatable by the configuration function, wherein different data of the sensor is selectively deactivatable and/or activatable, or data of different sensors is selectively deactivatable and/or activatable.

9. The antenna according to claim 1, wherein a base station array comprises at least one base station and at least one antenna, and wherein at least a first service provider and a second service provider jointly use the antenna.

10. A method of operating an antenna according to claim 1, the method comprising:

operating the antenna making use of a first subgroup of functional elements, accessing the configuration function of the antenna and activating a second subgroup of functional elements of the antenna, and operating the antenna making use of the first and second subgroups of functional elements.

11. The method according to claim 10, further comprising transmitting and/or receiving mobile communication signals.

12. The method according to claim 11, wherein additional ports and/or additional communication interfaces are activated, wherein the additional ports are used for transmitting and/or receiving in a further mobile communication frequency band, and/or wherein a further base station is connected to the second subgroup of functional elements.

13. The antenna according to claim 1, wherein the antenna is a mobile communication antenna.

14. The antenna according to claim 13, wherein the antenna is for a mobile communication base station.

15. An antenna comprising an antenna control unit, a plurality of radiators, and a plurality of functional elements, the antenna control unit having a configuration function which is accessed via an external control unit, wherein at least one functional element is deactivatable and/or activatable via the configuration function, wherein the functional elements comprise ports through which the plurality of radiators of the antenna has signals supplied thereto, wherein at least one port is selectively deactivatable and/or activatable via the configuration function, and/or wherein the plurality of radiators of the antenna is interconnected to form at least one phased array, wherein at least one port of the phased array is deactivatable and/or activatable through the configuration function, wherein, for deactivating and/or activating the ports, at least one switch is provided, which is mechanically shiftable from a first switching position to a second switching position, the shifting being controllable via the antenna control unit, wherein the switch for deactivating and/or activating a port deactivates the port at the first switching position and connects the port to at least one radiator at the second switching position.

16. The antenna according to claim 15, wherein the switch comprises a rotatably supported pickup, which, at the first switching position, disconnects a connection to a first signal line and, at the second switching position, establishes the connection to the first signal line, the first signal line being connected to a first line section of the switch for this purpose, the first line section coupling capacitively to a line section of the pickup via a dielectric layer at the second switching position, wherein the pickup is electrically coupled to a second signal line via a coupling point arranged in an area of its axis of rotation, and/or wherein the pickup, at the first switching position, establishes a connection to a terminal, in that the pickup, at the first switching position, capacitively couples to a second line section of the switch, which is connected to a termination.

17. The antenna according to claim 15, wherein the switch is operated via an actuator, which is also used for adjusting at least one phase shifter of the antenna, wherein the antenna comprises a plurality of phase shifters and the actuator is, via a changeover arrangement, selectively connectable to one of the phase shifters so as to adjust the antenna, wherein the changeover arrangement comprises a plurality of separate output elements for adjusting the plurality of phase shifters, wherein each of the plurality of output elements is connected to at least one of the plurality of phase shifters via a respective driving mechanism.

18. The antenna according to claim 17, wherein the switch and at least one phase shifter are jointly shifted by means of a common driving mechanism, which is operated by the actuator, wherein the driving mechanism is driven by an output element of the changeover arrangement, and/or wherein the switch and the at least one phase shifter are associated with a same group of radiators, and/or wherein the driving mechanism shifts the switch between the first and second switching positions in a first adjusting range and adjusts the at least one phase shifter in a second adjusting range, wherein a connection between the driving mechanism and the switch in the second adjusting range comprises a freewheeling range, so as to adjust the at least one phase shifter by further operating the driving mechanism, while the switch remains at the second switching position, and/or wherein a connection between the driving mechanism and the at least one phase shifter in the first adjusting range comprises a freewheeling range, so as to shift the switch by operating the driving mechanism, without shifting the at least one phase shifter, and/or wherein the at least one phase shifter is adjusted as well in the first adjusting range.

19. The antenna according to claim 17, wherein the switch and the phase shifter or phase shifters are each shifted by means of a separate driving mechanism, wherein the respective driving mechanisms are selectively connectable to the actuator via a changeover arrangement, wherein the switch and the at least one phase shifter are associated with a same group of radiators and/or wherein the driving mechanism for the switch and the driving mechanism for the phase shifter are coupled to separate output elements of the changeover arrangement.

* * * * *